US009068563B2

(12) United States Patent
Fukasaku

(10) Patent No.: US 9,068,563 B2
(45) Date of Patent: Jun. 30, 2015

(54) ELECTRIC CONNECTOR FOR COOLING A COMPRESSOR DRIVE CIRCUIT

(75) Inventor: Hiroshi Fukasaku, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 290 days.

(21) Appl. No.: 13/424,691

(22) Filed: Mar. 20, 2012

(65) Prior Publication Data

US 2012/0251355 A1 Oct. 4, 2012

(30) Foreign Application Priority Data

Mar. 31, 2011 (JP) ..... 2011-079839

(51) Int. Cl.
*F04D 35/00* (2006.01)
*F04C 15/00* (2006.01)
(Continued)

(52) U.S. Cl.
CPC ..... *F04B 17/03* (2013.01); *F04C 15/0096* (2013.01); *F04B 39/066* (2013.01); *F04B 53/06* (2013.01);
(Continued)

(58) Field of Classification Search
CPC .. F04B 39/0055; F04B 39/14; F04B 39/0072; F04B 53/08; F04B 53/16; F04B 17/03; F04B 35/04; F04B 39/06; F04B 39/064; F04B 39/066; F04B 53/06; F04D 25/06; F04D 13/0613; F04D 13/0653; F04D 13/086; F04D 25/0606; F04D 25/0686; F04D 25/0693; F04D 29/04; F04D 29/403; F04D 29/406; F04D 29/5813; F04D 29/582; F04D 25/0653; F04C 23/008; F04C 29/0085; F04C 15/0096; F04C 29/04; F04C 29/042; F04C 29/047; F04C 29/0007; F04C 2240/403
USPC ..... 417/348, 349, 357, 366, 388, 422, 417/410.1
See application file for complete search history.

(56) References Cited

U.S. PATENT DOCUMENTS 6,321,563 B1 11/2001 Ikeda et al.
7,147,443 B2 12/2006 Ogawa et al.
(Continued)

FOREIGN PATENT DOCUMENTS

CN 1508428 A 6/2004
DE 101 59 365 A1 7/2002
(Continued)

OTHER PUBLICATIONS

German Office Action for corresponding DE Patent Application No. 10 2012 204 703.4 issued on Nov. 26, 2012.
Chinese Office Action dated Apr. 29, 2014 issued in corresponding Chinese Application No. 201210082325.X.

*Primary Examiner* — Bryan Lettman
*Assistant Examiner* — Timothy P Solak
(74) *Attorney, Agent, or Firm* — Sughrue Mion, PLLC

(57) ABSTRACT

A motor-driven compressor has a housing and a partition. A compressing portion and an electric motor as the drive source of the compressing portion are accommodated in a first area. A drive circuit for the motor is arranged in a second area so as to have dissipation of the drive circuit. The compressor further includes a conductive member electrically connected to the circuit and fixed to the partition, and an electrical connection portion electrically connecting the conductive member to the motor. The connection portion is partly received in a passing area formed between the housing and the motor. The housing has a suction port and a discharge port. The discharge port is located at a position farther from the partition than the suction port and the passing area. An insertion member in the passing area restricts flow of refrigerant in the housing toward the discharge port via the passing area.

7 Claims, 6 Drawing Sheets

(51) Int. Cl.

| | |
|---|---|
| ***F04C 29/00*** | (2006.01) |
| ***F04D 25/06*** | (2006.01) |
| ***F04D 29/58*** | (2006.01) |
| ***F04B 17/03*** | (2006.01) |
| ***F04C 23/00*** | (2006.01) |
| ***F04C 29/04*** | (2006.01) |
| *F04B 39/06* | (2006.01) |
| *F04B 53/06* | (2006.01) |
| *F04B 35/04* | (2006.01) |
| *F04B 53/08* | (2006.01) |
| *F04C 18/02* | (2006.01) |

(52) U.S. Cl.

CPC ..... *F04D 29/5813* (2013.01); *F04B 35/04* (2013.01); *F04D 25/0606* (2013.01); *F04B 53/08* (2013.01); *F04C 2240/403* (2013.01); *F04C 29/0007* (2013.01); *F04C 23/008* (2013.01); *F04C 29/047* (2013.01); *F04C 18/0215* (2013.01); *F04C 2240/803* (2013.01); *F04C 2240/808* (2013.01)

(56) References Cited

U.S. PATENT DOCUMENTS

| | | | | |
|---|---|---|---|---|
| 2002/0073729 | A1 | 6/2002 | Shibuya | |
| 2004/0109772 | A1 | 6/2004 | Ogawa et al. | |
| 2005/0201873 | A1 * | 9/2005 | Ogawa et al. | 417/366 |
| 2009/0162221 | A1 * | 6/2009 | Iguchi et al. | 417/410.1 |
| 2010/0021320 | A1 * | 1/2010 | Watanabe et al. | 417/410.3 |
| 2010/0209266 | A1 * | 8/2010 | Ikeda et al. | 417/410.1 |
| 2010/0247348 | A1 | 9/2010 | Taguchi et al. | |
| 2011/0020153 | A1 | 1/2011 | Murakami | |
| 2011/0256002 | A1 | 10/2011 | Ikeda | |

FOREIGN PATENT DOCUMENTS

| | | | | |
|---|---|---|---|---|
| DE | 100 17 091 | C2 | 8/2003 | |
| EP | 2 159 425 | A2 * | 3/2010 | F04C 23/00 |
| JP | 2000-291557 | A | 10/2000 | |
| JP | 2005-201108 | A | 7/2005 | |
| JP | 2006-42409 | A | 2/2006 | |
| JP | 2010-048146 | A | 3/2010 | |
| JP | 2010-59809 | A | 3/2010 | |
| JP | 2010-144607 | A | 7/2010 | |

* cited by examiner

ELECTRIC CONNECTOR FOR COOLING A COMPRESSOR DRIVE CIRCUIT

BACKGROUND OF THE INVENTION

The present invention relates to a motor-driven compressor.

Japanese Laid-Open Patent Publication No. 2010-59809 discloses a motor-driven compressor that includes a compressing portion for compressing and discharging refrigerant, an electric motor for driving the compressing portion, and an inverter (drive circuit) for actuating the electric motor. The motor-driven compressor disclosed in Japanese Laid-Open Patent Publication No. 2010-59809 includes a motor housing member and a front housing member, which is secured to the front side of the motor housing member. The electric motor and the compression portion are accommodated in the area between the motor housing member and the front housing member. An inverter housing member is secured to a bottom (partition), which is at the rear of the motor housing member. An inverter accommodating chamber is defined between the bottom of the motor housing member and the inverter housing member. The inverter accommodating chamber accommodates the inverter, which is fixed to the bottom of the motor housing member. A part of an upper portion of the motor housing member forms a passage forming portion, which protrudes radially outward. The inner circumferential surface of the passage forming portion and the outer circumferential surface of the stator (stator core) of the electric motor define a wiring passage (passing area) inside the passage forming portion.

A cluster block, which is made of plastic, is arranged in the wiring passage. The cluster block is fixed to the outer circumferential surface of the stator via a joint member. A conductive member, which is electrically connected to the inverter, is fixed to the bottom of the motor housing member. The conductive member extends toward the wiring passage. Lead wires are drawn from the electric motor toward the wiring passage. The conductive member and the lead wires are electrically connected to each other via connection terminals in the cluster block. When assembling the motor-driven compressor, the cluster block is fitted into the motor housing member while being fixed to the outer circumferential surface of the stator, and is arranged in the wiring passage.

The motor housing member has a suction port that opens to the wiring passage. In the motor housing member, the suction port is located at a position closer to the bottom than the position at which the cluster block is located. The front housing member has a discharge port. When refrigerant is drawn into the motor housing through the suction port, the refrigerant cools the bottom. The cooling of the bottom by the refrigerant in turn cools the inverter fixed to the bottom.

A clearance is formed between the cluster block and the motor housing member of the motor-driven compressor disclosed in Japanese Laid-Open Patent Publication No. 2010-59809, so that the cluster block and the motor housing member do not interfere with each other during assembly of the motor-driven compressor. Further, the stator is fitted inside the motor housing member by shrink fitting. In the shrink fitting, the motor housing member is first heated for expansion. Then, the stator is inserted into the motor housing member.

Subsequently, as the temperature of the motor housing member drops to ordinary temperature, the motor housing member shrinks and is pressed against the outer circumferential surface of the stator. That is, since the temperature of the motor housing member is raised when it is heated and expanded, the cluster block may be melted when contacting the heated motor housing. The clearance is provided between the cluster block and the motor housing member to prevent such melting of the cluster block.

Such a clearance between the cluster block and the motor housing member allows refrigerant that has been drawn into the motor housing member via the suction port to flow to the front housing member (discharge port) through the clearance. This reduces the amount of refrigerant flowing toward the bottom of the motor housing member, which hinders efficient cooling of the bottom by the refrigerant. As a result, the cooling performance for the inverter deteriorates.

Such a problem is substantially common to any type of motor-driven compressors having a passing area that receives a part of an electrical connection portion for electrically connecting a conductive member with an electric motor.

Further, in a motor-driven compressor in which an inverter, a compressing portion, and an electric motor are arranged in that order along the axial direction of the rotary shaft of the electric motor, a passing area is defined by the inner surface of the housing and the outer circumferential surface of the compressing portion, and a part of an electrical connection portion is passed through the passing area. In this case, some high-temperature and high-pressure refrigerant, which is generated through compression in the compressing portion, flows toward the partition through the passing area to undesirably warm the partition. As a result, the cooling performance for the inverter deteriorates.

SUMMARY OF THE INVENTION

Accordingly, it is an objective of the present invention to provide a motor-driven compressor that improves cooling performance for a drive circuit.

To achieve the foregoing objective and in accordance with one aspect of the present invention a motor-driven compressor is provided that includes a housing, a partition defining inside the housing a first area and a second area, which are isolated from each other, a compressing portion, an electric motor, a drive circuit, a conductive member, and an electrical connection portion. The compressing portion and the electric motor are accommodated in the first area. The electric motor is a drive source of the compressing portion. The drive circuit drives the electric motor and is arranged in the second area so as to have dissipation of the drive circuit. The conductive member is electrically connected to the drive circuit and is fixed to the partition. The electrical connection portion electrically connects the conductive member and the electric motor to each other. A part of the electrical connection portion is received in a passing area formed between the housing and the electric motor. The housing has a suction port and a discharge port. The discharge port is located at a position that is farther from the partition than the suction port and the passing area. An insertion member is located in the passing area. After refrigerant is drawn into the housing via the suction port, the insertion member increases flow of refrigerant toward the partition by restricting flow of refrigerant toward the discharge port via the passing area.

In accordance with a second aspect of the present invention, a motor-driven compressor is provided that includes a housing, a partition defining inside the housing a first area and a second area, which are isolated from each other, a compressing portion, an electric motor, a drive circuit, a conductive member, and an electrical connection portion. The compressing portion and the electric motor are accommodated in the first area. The electric motor is a drive source of the compressing portion. The drive circuit drives the electric motor, and is arranged in the second area so as to have dissipation of the drive circuit. The conductive member is electrically connected to the drive circuit and is fixed to the partition. The electrical connection portion electrically connects the conductive member and the electric motor to each other. A part of the electrical connection portion is received in a passing area formed between the housing and the compressing portion. The housing has a suction port and a discharge port. The discharge port is located at a position that is farther from the partition than the suction port and the passing area. An insertion member is located in the passing area. After refrigerant is discharged from the compressing portion, the insertion member increases flow of refrigerant toward the discharge port by restricting flow of refrigerant toward the partition via the passing area.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A first embodiment of the present invention will now be described with reference to FIGS. 1 to 3.

Figure 1:
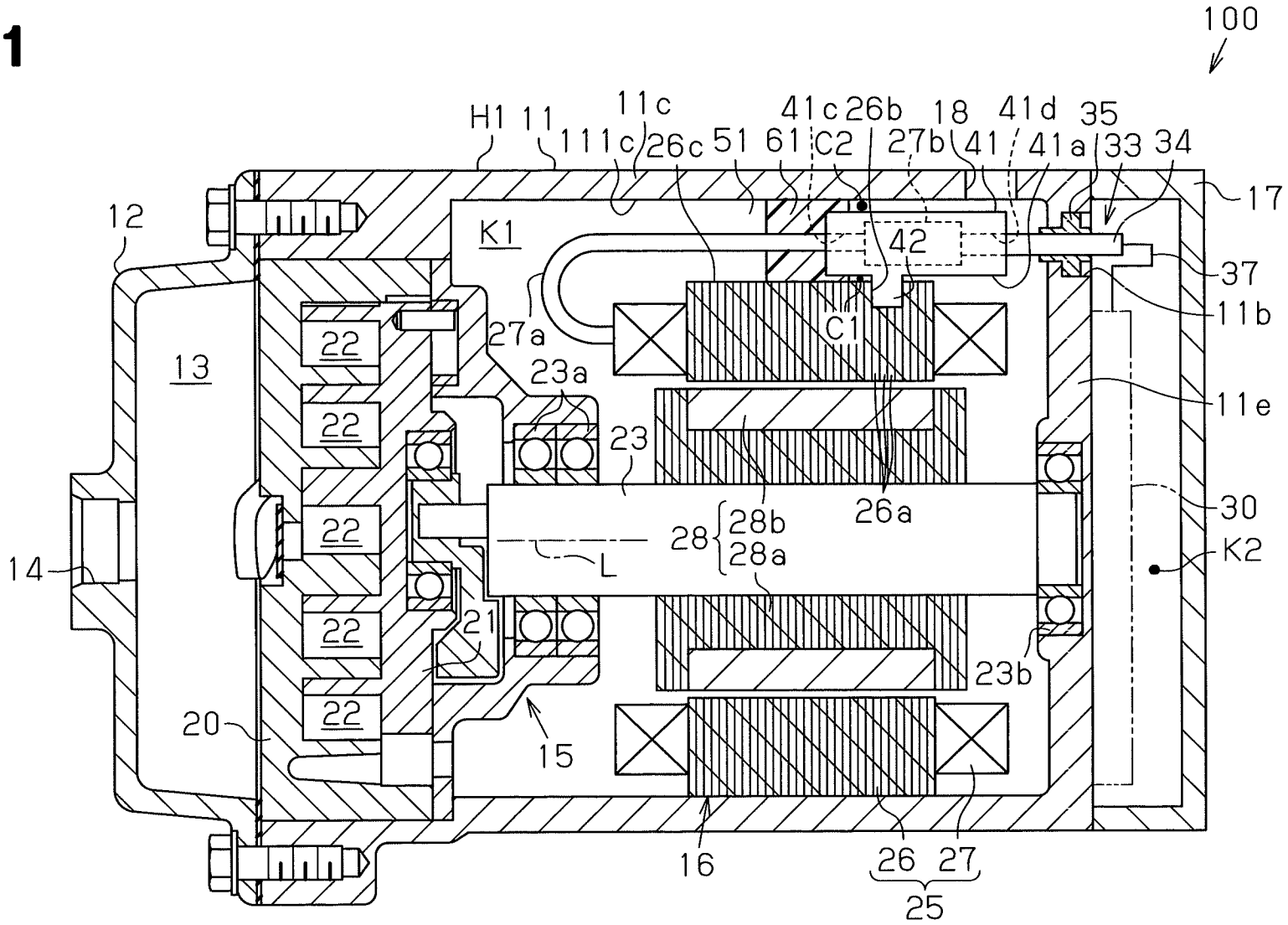
FIG. 1 is a cross-sectional side view showing a motor-driven compressor according to a first embodiment of the present invention.

As shown in FIG. 1, a motor-driven compressor 100 includes a cylindrical suction housing member 11, which is made of metal and has a closed end, and a discharge housing member 12 joined to the open end (left end as viewed in FIG. 1) of the suction housing member 11. The discharge housing member 12 is also made of metal and has a closed end. A discharge chamber 13 is defined between the suction housing member 11 and the discharge housing member 12. An inverter housing member 17, which is made of metal, is joined to a bottom wall 11*e* of the suction housing member 11. In the present embodiment, the suction housing member 11, the discharge housing member 12, and the inverter housing member 17 are made of aluminum. The suction housing member 11, the discharge housing member 12, and the inverter housing member 17 form a housing H1 of the motor-driven compressor 100 according to the present embodiment.

The bottom wall 11*e* functions as a partition that divides the interior of the housing H1 into a first area K1 and a second area K2. That is, the bottom wall 11*e*, the cylindrical circumferential wall of the suction housing member 11, and the discharge housing member 12 define the first area K1 in the housing H1, and the bottom wall 11*e* and the inverter housing member 17 define the second area K2 in the housing H1.

The first area K1 accommodates a compressing portion 15 for compressing refrigerant and an electric motor 16, which is a drive source of the compressing portion 15. The second area K2 accommodates an inverter 30, which is a drive circuit for driving the electric motor 16 (represented by a chain double-dashed line in FIG. 1). In the second area K2, the inverter 30 is arranged so as to have dissipation of the inverter 30. In the present embodiment, the inverter 30 is attached to and closely contacts the outer surface of the bottom wall 11*e* to be thermally coupled to the bottom wall 11*e*.

The compressing portion 15 includes a stationary scroll 20 fixed in the suction housing member 11 and a movable scroll 21, which is arranged to face the stationary scroll 20. Compression chambers 22, each having a variable volume, are defined between the stationary scroll 20 and the movable scroll 21. A rotary shaft 23 is accommodated in the suction housing member 11. The rotary shaft 23 is rotationally supported by the suction housing member 11 through radial bearings 23*a*, 23*b*.

The electric motor 16 is located closer to the bottom wall 11*e* (right side as viewed in FIG. 1) of the suction housing member 11 than the compressing portion 15. Therefore, in the present embodiment, the compressing portion 15, the electric motor 16, and the inverter 30 are accommodated in the housing H1 to be arranged in that order along the direction of the axis L of the rotary shaft 23 (axial direction).

A stator 25 is fixed to the inner circumferential surface of the suction housing member 11. The stator 25 includes an annular stator core 26, which is fixed to the inner circumferential surface of the suction housing member 11. The stator core 26 has teeth (not shown), and a coil 27 wound about each tooth. The stator core 26 is formed by stacking a plurality of core plates 26*a*, each of which is formed by a magnetic body (an electromagnetic steel plate). An insertion recess 26*b* is formed in an outer circumferential surface 26*c* of the stator core 26. The insertion recess 26*b* is formed by making cuts in the outer circumferential surface of some (four in the present embodiment) of the core plates 26*a*. A rotor 28 is located radially inside the stator 25. The rotor 28 is formed by a rotor core 28*a*, which is fixed to the rotary shaft 23, and permanent magnets 28*b*, which are provided on the circumferential surface of the rotor core 28*a*.

A part of an upper portion of the suction housing member 11 forms a passage forming portion 11*c*, which protrudes radially outward. Inside the passage forming portion 11*c*, an inner surface 111*c* of the passage forming portion 11*c* and the outer circumferential surface 26*c* of the stator core 26 define a passing area 51. A cluster block 41, which is formed as a rectangular box made of synthetic plastic, is located in the passing area 51. Connection terminals 27*b* are located in the cluster block 41. As shown in FIG. 3, an outer bottom surface 41*a* of the cluster block 41 is formed to be arcuate to conform to the outer circumferential surface 26*c* of the stator core 26, and extends parallel with the axial direction of the stator core 26.

As shown in FIG. 1, an attaching projection 42 is formed on the outer bottom surface 41*a* of the cluster block 41. The attaching projection 42 is insertable in the insertion recess 26*b*. By inserting the attaching projection 42 into the insertion recess 26*b*, the cluster block 41 is attached to the outer circumferential surface 26*c* of the stator core 26. With the cluster block 41 attached to the outer circumferential surface 26*c* of the stator core 26, a clearance C1 is formed between the outer bottom surface 41*a* of the cluster block 41 and the outer circumferential surface 26*c* of the stator core 26, and a clearance C2 is formed between the cluster block 41 and the inner surface 111*c* of the passage forming portion 11*c*.

Lead wires 27*a* (only one which is shown in FIG. 1) of the U-phase, the V-phase, and the W-phase are drawn out of the ends of the coils 27 closer to the compressing portion 15 and extend toward the passing area 51. The starting ends of the lead wires 27*a* are connected to the connection terminals 27*b* through first passing holes 41*c* in the cluster block 41. A part of each lead wire 27*a* is passed through the passing area 51.

A through hole 11*b* is formed in the bottom wall 11*e* of the suction housing member 11. A sealing terminal 33 is arranged in the through hole 11*b*. The sealing terminal 33 includes three metal terminals 34 and three glass insulation members 35. Each of the metal terminals 34 serves as a conductive member electrically connected to the inverter 30. Each of the insulation members 35 insulates one of the metal terminals 34 and fixes it to the bottom wall 11*e*. FIG. 1 shows only one of the metal terminals 34 and the corresponding one of the insulation members 35. Each metal terminal 34 has a first end, which is electrically connected to the inverter 30 via a cable 37, and a second end, which extends toward the passing area 51. The second ends are passed through second passing holes 41*d* in the cluster block 41 and inserted into the cluster block 41 to be electrically connected to the connection terminals 27*b*. In the present embodiment, the lead wires 27*a* and the cluster block 41 form an electrical connection portion, which connects the metal terminals 34 and the electric motor 16 to each other.

A suction port 18 is formed in the passage forming portion 11*c* (the suction housing member 11). In the passage forming portion 11*c*, the suction port 18 is located at a position adjacent to the bottom wall lie and opens to the passing area 51. A discharge port 14 is formed in the bottom wall (left side as viewed in FIG. 1) of the discharge housing member 12. The suction port 18 and the discharge port 14 are connected to an external refrigerant circuit (not shown). Thus, in the housing H1, the discharge port 14 is located at a position farther from the bottom wall lie than the suction port 18 and the passing area 51.

Figure 2:
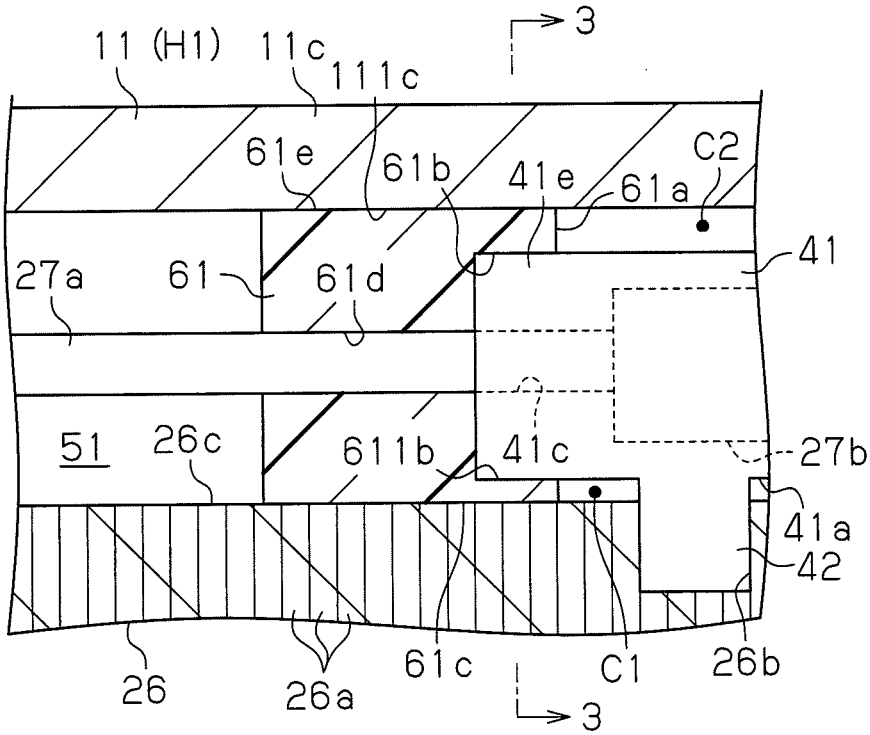
FIG. 2 is an enlarged cross-sectional view illustrating the insertion member of FIG. 1.
Figure 3:
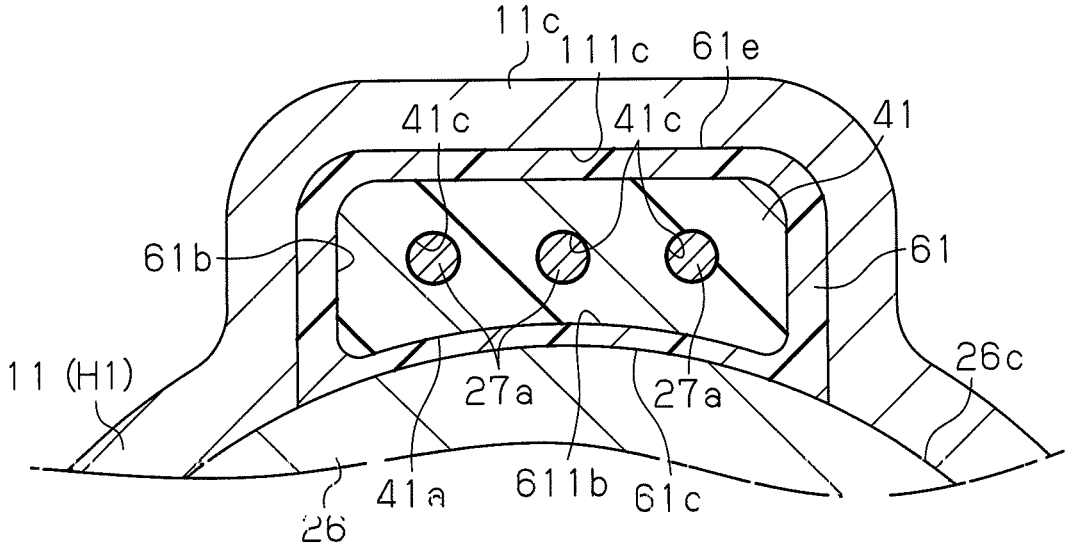
FIG. 3 is a cross-sectional view taken along line 3-3 in FIG. 2.

As shown in FIG. 2, an insertion member 61, which is made of plastic, is provided between the outer circumferential surface 26*c* of the stator core 26 and the inner surface 111*c* of the passage forming portion 11*c*. In the insertion member 61, a fitting recess 61*b* is formed in an end face 61*a* that faces the cluster block 41. The fitting recess 61*b* is adapted to receive an end 41*e* of the cluster block 41 that corresponds to the first passing holes 41*c*. By fitting the end 41*e* of the cluster block 41 into the fitting recess 61*b*, the insertion member 61 is integrated with the cluster block 41.

The insertion member 61 has passing holes 61*d*, which serve as a passing portion for passing the lead wires 27*a*. As shown in FIG. 3, a bottom surface 61*c* of the insertion member 61 is formed to be arcuate to conform to the outer circumferential surface 26*c* of the stator core 26, and extends parallel with the axial direction of the stator core 26. The bottom surface 61*c* contacts the outer circumferential surface 26*c*. An outer surface 61*e* of the insertion member 61 that faces the inner surface 111*c* of the passage forming portion 11*c* is formed to conform to the inner surface 111*c*. The outer surface 61*e* contacts the inner surface 111*c*. The movement of the insertion member 61 in the passing area 51 is restricted by contact between the bottom surface 61*c* and the outer circumferential surface 26*c* and contact between the outer surface 61*e* and the inner surface 111*c*. A bottom surface 611*b* of the fitting recess 61*b* is formed to be arcuate to conform to the outer bottom surface 41*a* of the cluster block 41.

The cluster block 41, to which the lead wires 27*a* and the connection terminals 27*b* are connected, is attached to the outer circumferential surface 26*c* of the stator core 26 as shown in FIG. 1. In this state, the stator 25 is fitted in the suction housing member 11 by shrink fitting. In the shrink fitting process, the suction housing member 11 is first heated and expanded. Then, the stator 25 is inserted into the suction housing member 11 so that the cluster block 41 is received in the passing area 51. Subsequently, as the temperature of the suction housing member 11 drops to ordinary temperature, the suction housing member 11 shrinks and is pressed against the outer circumferential surface of the stator 25. With the stator 25 fitted in the suction housing member 11, the sealing terminal 33 is arranged in the through hole 11*b*, and the metal terminals 34 are connected to the connection terminals 27*b* via the second through hole 41*d*.

Subsequently, the insertion member 61 with the lead wires 27*a* passed through the through holes 61*d* is inserted in the passing area 51, such that the fitting recess 61*b* is fitted to the end 41*e* of the cluster block 41. The insertion member 61 closes the clearance C1 between the outer bottom surface 41*a* of the cluster block 41 and the outer circumferential surface 26*c* of the stator core 26, and the clearance C2 between the cluster block 41 and the inner surface 111*c* of the passage forming portion 11*c*. The insertion member 61 is provided to extend over the cluster block 41 and the lead wires 27*a*.

Operation of the motor-driven compressor 100 will now be described.

In the motor-driven compressor 100, electricity that has been controlled by the inverter 30 is supplied to the electric motor 16, so that the rotary shaft 23 rotates together with the rotor 28 at a controlled rotational speed. Accordingly, the volume of each compression chamber 22 between the stationary scroll 20 and the movable scroll 21 is reduced in the compressing portion 15. This causes refrigerant to be drawn into the suction housing member 11 from the external refrigerant circuit via the suction port 18. The refrigerant drawn into the suction housing member 11 is dispersed and flows either along the bottom wall 11*e* or toward the compressing portion 15 via the passing area 51.

As described above, the insertion member 61, which is provided in the passing area 51, closes the clearance C1 between the outer bottom surface 41*a* of the cluster block 41 and the outer circumferential surface 26*c* of the stator core 26, and the clearance C2 between the cluster block 41 and the inner surface 111*c* of the passage forming portion 11*c*. Thus, after refrigerant is drawn into the suction housing member 11 via the suction port 18, the insertion member 61 increases flow of the refrigerant toward the bottom wall 11*e* by restricting flow of the refrigerant toward the compressing portion 15 (the discharge port 14). Most of the refrigerant that has been drawn into the suction housing member 11 via the suction port 18 flows to and cools the bottom wall 11*e*. The bottom wall 11*e* is efficiently cooled, which cools the inverter 30, which is thermally coupled to the bottom wall 11*e*.

Subsequently, the refrigerant that has flowed to the bottom wall 11*e* flows toward the compressing portion 15 in the suction housing member 11 via a passage (not shown)

between the inner circumferential surface of the suction housing member 11 and the outer circumferential surface of the stator 25. The refrigerant is then drawn into the compression chambers 22 and compressed there. The compressed refrigerant is sent to the discharge chamber 13 and then to the external refrigerant circuit via the discharge port 14. The refrigerant is then returned to the suction housing member 11.

The first embodiment has the following advantages.

(1) The insertion member 61 is provided between the outer circumferential surface 26*c* of the stator core 26 and the inner surface 111*c* of the passage forming portion 11*c*. The insertion member 61 closes the clearance C1 between the outer bottom surface 41*a* of the cluster block 41 and the outer circumferential surface 26*c* of the stator core 26, and the clearance C2 between the cluster block 41 and the inner surface 111*c* of the passage forming portion 11*c*. Thus, after the refrigerant is drawn into the suction housing member 11 via the suction port 18, the flow of the refrigerant toward the bottom wall 11*e* is increased by restricting the flow of the refrigerant toward the compressing portion 15 (the discharge port 14). Most of the refrigerant that has been drawn into the suction housing member 11 via the suction port 18 flows to and cools the bottom wall 11*e*. This allows the bottom wall 11*e* to be efficiently cooled. As a result, the cooling performance for the inverter 30, which is thermally coupled to the bottom wall 11*e*, is improved.

(2) In the motor-driven compressor 100 of the present embodiment, the compressing portion 15, the electric motor 16, and the inverter 30 are arranged in that order along the axial direction of the rotary shaft 23. The lead wires 27*a* are drawn out from ends of the coils 27 that are closer to the compressing portion 15. Thus, the electric motor 16 and the inverter 30 do not need to be electrically connected to each other in the narrow area in between (in the illustrated embodiment, the area between an end face of the stator core 26 that faces the inverter 30 and bottom wall 11*e* of the suction housing member 11). That is, the area between the compressing portion 15 and the electric motor 16 can be used for wire connecting operation. That is, in the motor-driven compressor 100, in which the compressing portion 15, the electric motor 16, and the inverter 30 are serially arranged in that order, the lead wires 27*a* can be drawn toward the compressing portion 15 and then be connected to the connection terminals 27*b* in the cluster block 41. Also, the wire connecting operation is completed simply by connecting the metal terminals 34 to the connection terminals 27*b* in the cluster block 41. This facilitates the operation. This improves the efficiency of the assembly of the motor-driven compressor 100. Also, by arranging the sealing terminal 33 in the through hole 11*b* with the cluster block 41 attached to the stator core 26, the metal terminals 34 and the connection terminals 27*b* can be electrically connected to each other. Thus, attaching of the sealing terminal 33 to the through hole 11*b* and the connecting of the metal terminals 34 to the connection terminals 27*b* together can be performed simultaneously.

(3) The cluster block 41 is attached to the outer circumferential surface 26*c* of the stator core 26. Therefore, the cluster block 41 does not increase the size of the motor-driven compressor 100 in the axial direction. At the assembly of the motor-driven compressor 100, the clearance C2 is formed between the cluster block 41 and the inner surface 111*c* of the passage forming portion 11*c* so that the cluster block 41 attached to the outer circumferential surface 26*c* of the stator core 26 does not interfere with the passage forming portion 11*c* of the suction housing member 11. However, according to the present embodiment, the insertion member 61 is provided between the outer circumferential surface 26*c* of the stator core 26 and the inner surface 111*c* of the passage forming portion 11*c* to close the clearance C2. Thus, after the refrigerant is drawn into the suction housing member 11 via the suction port 18, the flow of the refrigerant toward the compressing portion 15 via the clearance C2 between the cluster block 41 and the passage forming portion 11*c* is restricted.

(4) The insertion member 61 is provided integrally with the cluster block 41. The cluster block 41 itself is attached to the outer circumferential surface 26*c* of the stator core 26, so that the position of the cluster block 41 is determined. Since the insertion member 61 is integrated with the cluster block 41, the position of which is determined, the position of the insertion member 61 is easily determined.

(5) The bottom surface 61*c* of the insertion member 61 contacts the outer circumferential surface 26*c* of the stator core 26, and the outer surface 61*e* of the insertion member 61 contacts the inner surface 111*c* of the passage forming portion 11*c*. These contacting states restrict the movement of the insertion member 61 in the passing area 51, so that the insertion member 61 is fixed in the passing area 51.

(6) The inverter 30 is attached to the outer surface of the bottom wall 11*e* in the second area K2. Therefore, for example, compared to a case in which the inverter 30 is attached to the inverter housing member 17 in the second area K2, the inverter 30 is more efficiently cooled when refrigerant drawn in via suction port 18 cools the bottom wall 11*e*.

(7) The insertion member 61 is made of plastic. Therefore, even if the insertion member 61 interferes with the suction housing member 11 when the insertion member 61 is inserted into the passing area 51 such that the end 41*e* of the cluster block 41 is fitted in the fitting recess 61*b*, the insertion member 61 is deformed so that it can be easily assembled in the passing area 51.

(8) The insertion member 61 has passing holes 61*d* for passing the lead wires 27*a*. Since the passing holes 61*d* can be formed in the insertion member 61, there is no need to form passing holes, for example, in the passage forming portion 11*c* and the stator core 26, which form the passing area 51. Therefore, the structure of the motor-driven compressor 100 is prevented from being complicated because of such formation of passing holes.

Second Embodiment

A second embodiment of the present invention will now be described with reference to FIG. 4. In the following description, like or the same reference numerals are given to those components that are like or the same as the corresponding components of the first embodiment and detailed explanations are omitted or simplified.

Figure 4:
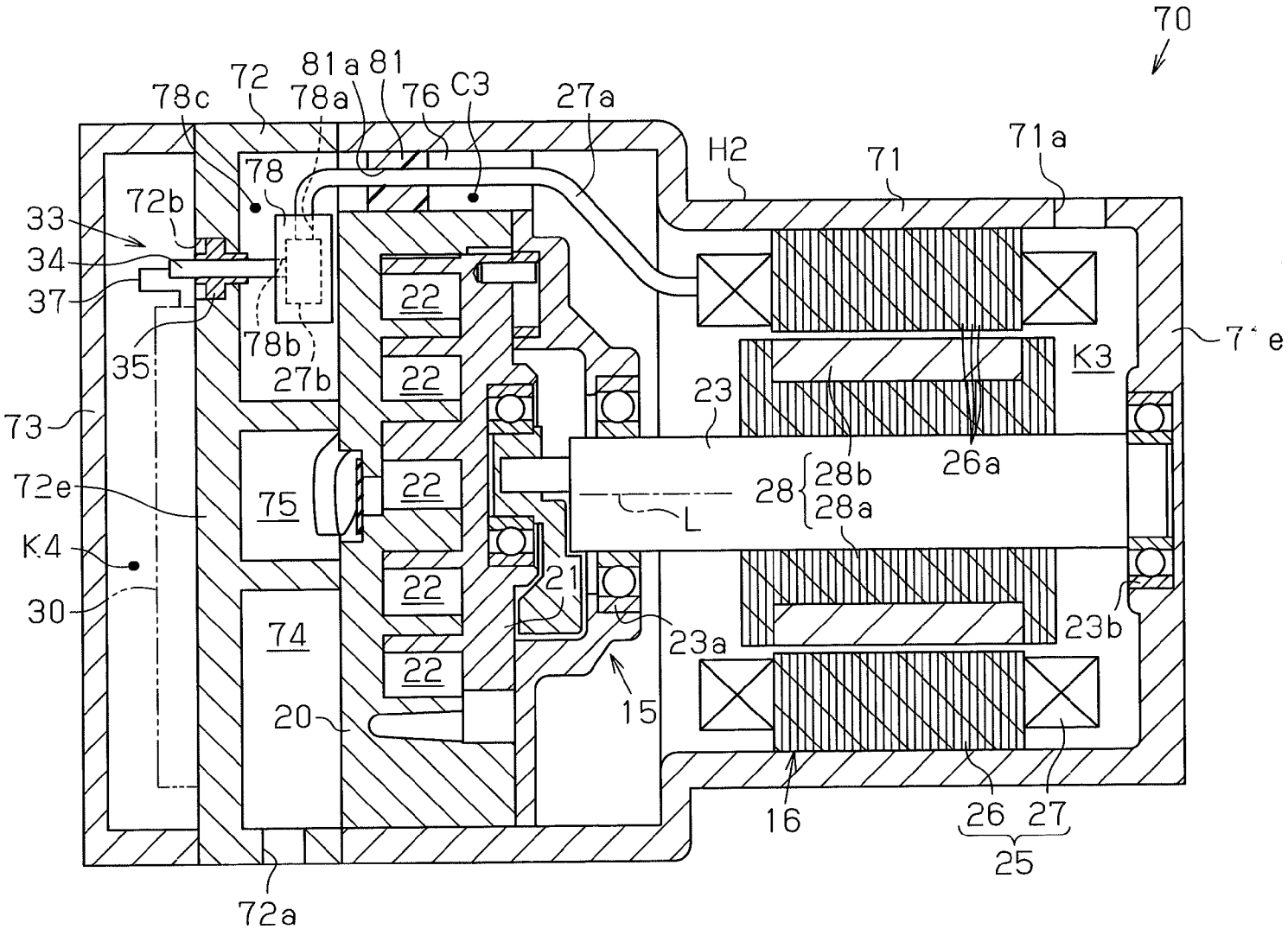
FIG. 4 is a cross-sectional side view showing a motor-driven compressor according to a second embodiment of the present invention.

As shown in FIG. 4, a motor-driven compressor 70 includes a cylindrical first housing member 71, which is made of metal and has a closed end, and a second housing member 72 joined to the open end (left end as viewed in FIG. 4) of the first housing member 71. The second housing member 72 is also made of metal and has a closed end. An inverter housing member 73, which is made of metal, is joined to a bottom wall 72*e* of the second housing member 72. In the present embodiment, the first housing member 71, the second housing member 72, and the inverter housing member 73 are made of aluminum. The first housing member 71, the second housing member 72, and the inverter housing member 73 form a housing H2 of the motor-driven compressor 70 according to the present embodiment.

The bottom wall 72*e* functions as a partition that divides the interior of the housing H2 into a first area K3 and the second area K4. That is, the bottom wall 72*e*, the circumferential wall of the second housing member 72, and the first housing member 71 define the first area K3 in the housing H2, and the bottom wall 72*e* and the inverter housing member 73 define the second area K4 in the housing H2.

The first area K3 accommodates a compressing portion 15 and an electric motor 16. The second area K4 accommodates an inverter 30, which is a drive circuit. In the second area K4, the inverter 30 is arranged so as to have dissipation of the inverter 30. In the present embodiment, the inverter 30 is attached to and closely contacts the outer surface of the bottom wall 72*e* to be thermally coupled to the bottom wall 72*e*. The electric motor 16 is located closer to the bottom wall 71*e* (right side as viewed in FIG. 4) of the first housing member 71 than the compressing portion 15. Therefore, in the present embodiment, the inverter 30, the compressing portion 15, and the electric motor 16 are accommodated in the housing H2 to be arranged in that order along the direction of the axis L of the rotary shaft 23 (axial direction).

A suction chamber 74, a discharge chamber 75, and an accommodating chamber 78*c* are defined between the second housing member 72 and the stationary scroll 20. The accommodating chamber 78*c* accommodates a cluster block 78. A passing area 76 is defined between the outer circumferential surface of the stationary scroll 20 and the inner circumferential surface of the first housing member 71. The passing area 76 connects the accommodating chamber 78*c* to a area in the first housing member 71 that is closer to the compressing portion 15 than the electric motor 16.

Lead wires 27*a* (only one which is shown in FIG. 4) of the U-phase, the V-phase, and the W-phase are drawn out of the ends of the coils 27 closer to the compressing portion 15 and extend toward the passing area 76. The starting end of each lead wire 27*a* is connected to the connection terminals 27*b* through first passing holes 78*a* of the cluster block 78 accommodated in the accommodating chamber 78*c*. A part of each lead wire 27*a* is passed through the passing area 76.

A through hole 72*b* is formed in the bottom wall 72*e* of the second housing member 72. A sealing terminal 33 is arranged in the through hole 72*b*. The metal terminals 34 of the sealing terminal 33 are passed through second passing holes 78*b* in the cluster block 78 and inserted into the cluster block 78 to be electrically connected to the connection terminals 27*b*. In the present embodiment, the lead wires 27*a* and the cluster block 78 form an electrical connection portion, which connects the metal terminals 34 and the electric motor 16 to each other.

A suction port 72*a* is formed in the second housing member 72. The suction port 72*a* is located at a position adjacent to the bottom wall 72*e* and opens to the suction chamber 74. A discharge port 71*a* is formed in the circumferential wall of the first housing member 71. In the circumferential wall of the first housing member 71, the discharge port 71*a* is located at a position adjacent to the bottom wall 71*e*. Thus, in the housing H2, the discharge port 71*a* is located at a position farther from the bottom wall 72*e* than the suction port 72*a* and the passing area 76.

An insertion member 81 is provided in the passing area 76. The insertion member 81 has passing holes 81*a*, which serve as a passing portion for passing the lead wires 27*a*. The insertion member 81 is located in the passing area 76. This restricts the communication of accommodating chamber 78*c*, via the clearance C3 between the passing area 76 and the lead wires 27*a*, with a area in the first housing member 71 that is closer to the compressing portion 15 than the electric motor 16.

Operation of the motor-driven compressor 70 having the above described configuration will now be described.

In the motor-driven compressor 70, refrigerant that has been drawn into the suction chamber 74 from the external refrigerant circuit via the suction port 72*a* is drawn into the compression chambers 22 via a passage (not shown) formed in the stationary scroll 20, and compressed there. The compressed refrigerant is sent to the discharge chamber 75 and is then sent toward the compressing portion 15 in the first housing member 71 via a passage (not shown) formed in the first housing member 71.

Subsequently, the refrigerant sent toward the compressing portion 15 in the first housing member 71 is dispersed and flows either toward the discharge port 71*a* or toward the passing area 76.

The insertion member 81 is located in the passing area 76, and the insertion member 81 closes the clearance C3 between the passing area 76 and the lead wires 27*a*. Thus, after the refrigerant is discharged by the compressing portion 15, the insertion member 81 increases flow of the refrigerant toward the discharge port 71*a* by restricting the flow of the refrigerant to the accommodating chamber 78*c* via the passing area 76 than toward the compressing portion 15 from the first housing member 71. Thus, most of the refrigerant drawn to the first housing member 71 flows to the discharge port 71*a*. Subsequently, the refrigerant that has flowed toward the discharge port 71*a* flows out to the external refrigerant circuit via the discharge port 71*a*, and is then returned to the suction chamber 74.

The second embodiment therefore has the following advantages.

(9) When refrigerant is compressed in the compressing portion 15, the temperature and pressure of the refrigerant are increased. Thus, high-temperature and high-pressure refrigerant is sent to the discharge chamber 75. The insertion member 81 increases flow of the refrigerant toward the discharge port 71*a* by restricting the flow of the high-temperature and high-pressure refrigerant toward the bottom wall 72*e* via the passing area 76. Accordingly, most of the refrigerant discharged from the compressing portion 15 flows toward the discharge port 71*a*, which prevents the bottom wall 72*e* from being heated by the high-temperature and high-pressure refrigerant. As a result, the inverter 30, which is thermally coupled to the bottom wall 72*e*, is prevented from being heated. The cooling performance for the inverter 30 is therefore prevented from deteriorating.

The above described embodiments may be modified as follows.

Figure 5:
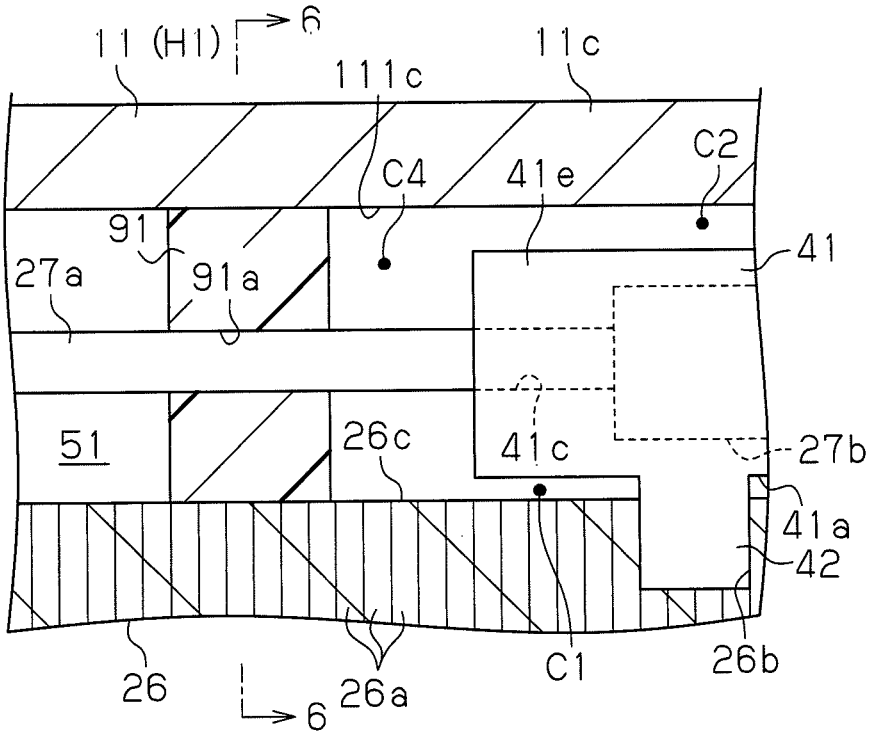
FIG. 5 is an enlarged cross-sectional view illustrating the insertion member according to another embodiment.
Figure 6:
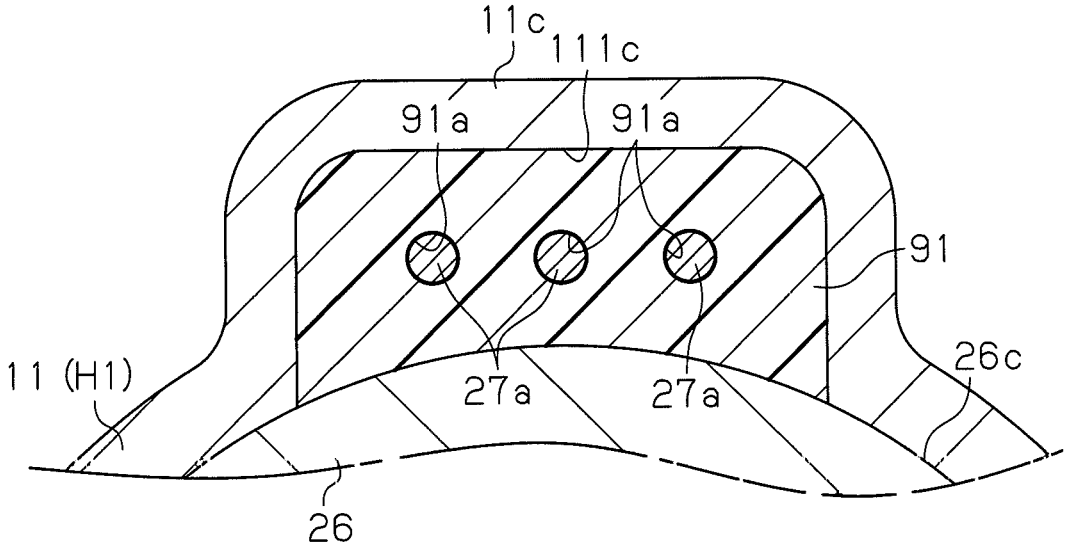
FIG. 6 is a cross-sectional view taken along line 6-6 in FIG. 5.

In the first embodiment, the insertion member 61 does not need to be provided integrally with the cluster block 41. For example, as shown in FIGS. 5 and 6, an insertion member 91 may be integrally formed with the lead wires 27*a* and separated from the cluster block 41. The insertion member 91 has passing holes 91*a*, which serve as a passing portion for passing the lead wires 27*a*. The insertion member 91 is located in the passing area 51. The insertion member 91 closes the clearance C4 between the passing area 51 and the lead wires 27*a*.

In the first embodiment, the insertion member 61 is provided to extend over the cluster block 41 and the lead wires 27*a*. Instead, the insertion member 61 may be provided only about the cluster block 41.

In the first embodiment, the compressing portion 15, the electric motor 16, and the inverter 30 do not need to be arranged in that order along the axial direction of the rotary shaft 23. For example, the inverter 30 may be accommodated in a second area defined between the circumferential wall of the suction housing member 11 and an inverter cover fixed to the circumferential wall. In this case, the circumferential wall of the suction housing member 11 functions as a partition.

In the first embodiment, by inserting the attaching projection 42 into the insertion recess 26*b*, the cluster block 41 is attached to the outer circumferential surface 26*c* of the stator core 26. However, the configuration for attaching the cluster block 41 to the outer circumferential surface 26*c* of the stator core 26 is not limited to this.

In the first embodiment, the cluster block 41 does not need to be attached to the outer circumferential surface 26*c* of the stator core 26.

Figure 7:
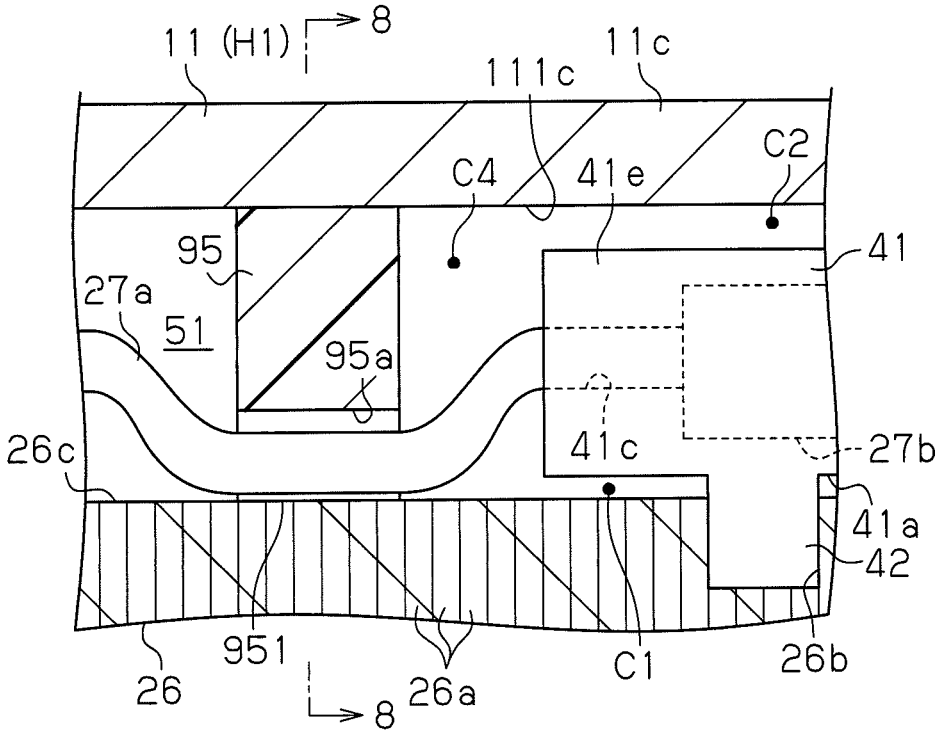
FIG. 7 is an enlarged cross-sectional view illustrating the insertion member according to another embodiment.
Figure 8:
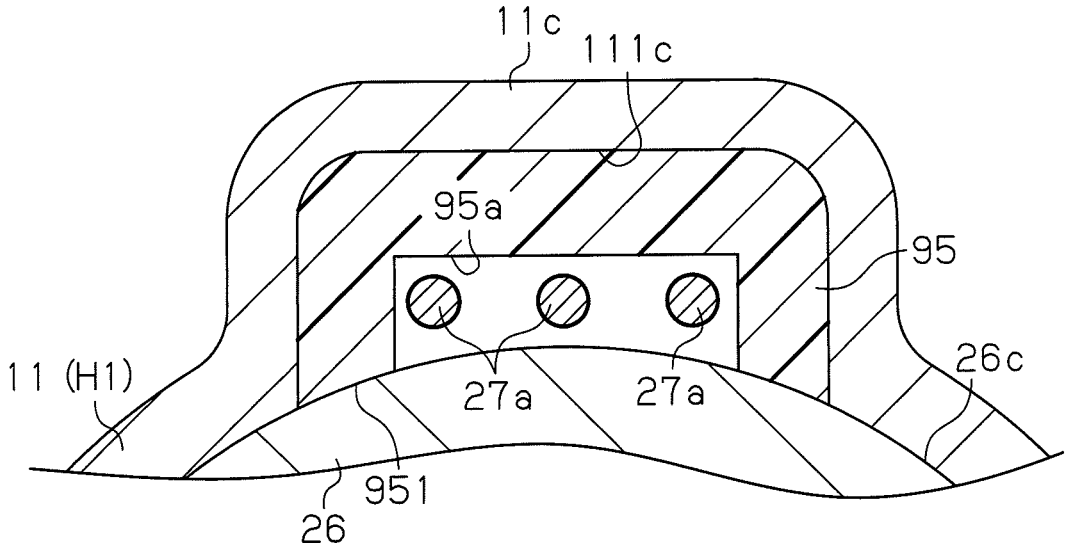
FIG. 8 is a cross-sectional view taken along line 8-8 in FIG. 7.

Each of the above embodiments may be modified, for example, as shown in FIGS. 7 and 8. In this modification, a passing recess 95*a*, which functions as a passing portion, is formed in a part of an insertion member 95 that faces the outer circumferential surface 26*c* of the stator core 26, and the lead wires 27*a* are received in the passing recess 95*a*.

Figure 9:
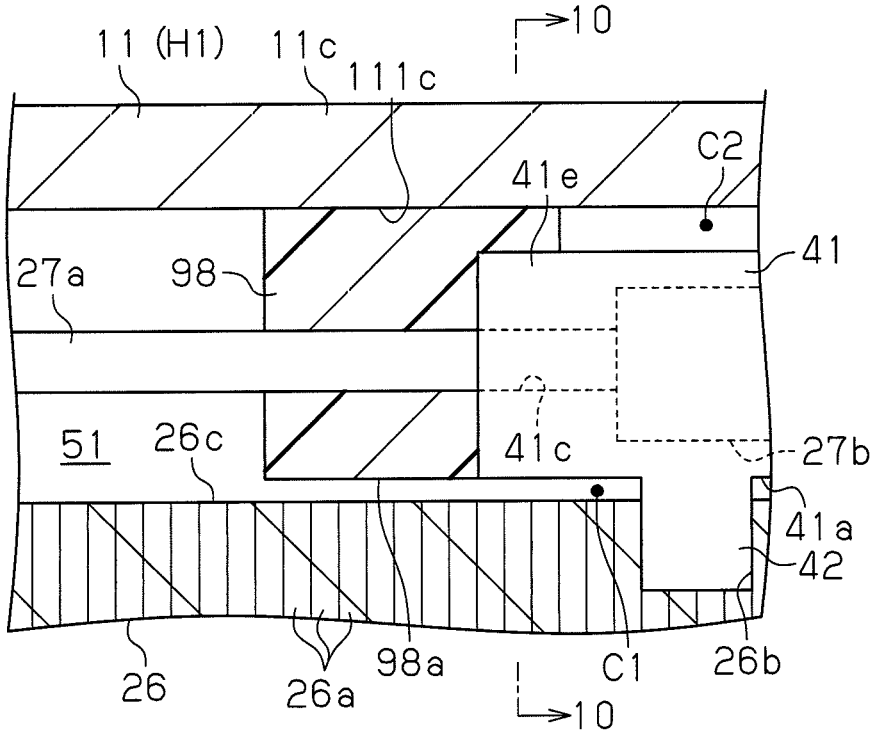
FIG. 9 is an enlarged cross-sectional view illustrating the insertion member according to another embodiment.
Figure 10:
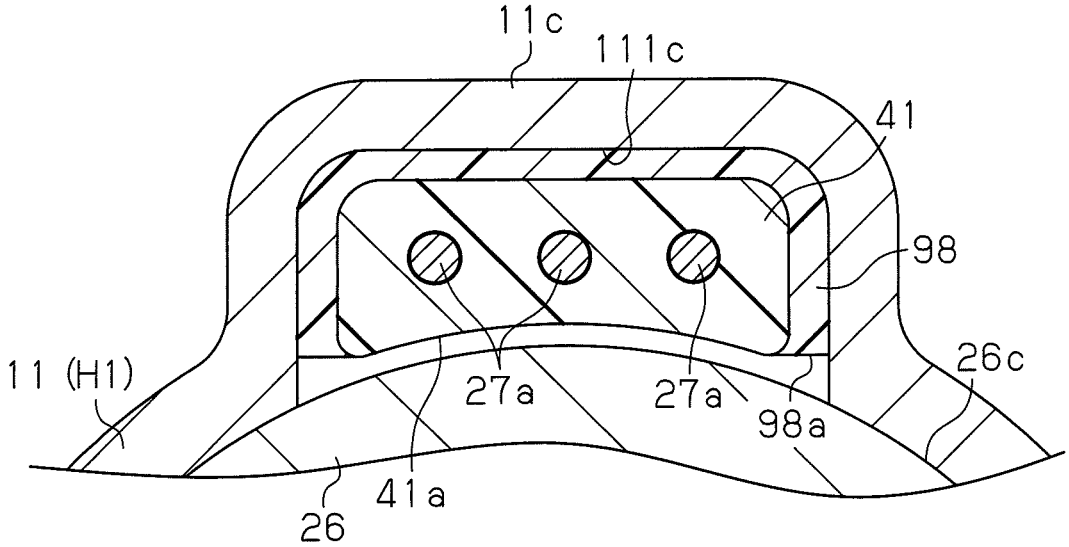
FIG. 10 is a cross-sectional view taken along line 10-10 in FIG. 9.

As shown in FIGS. 9 and 10, a bottom surface 98*a* of an insertion member 98 may be separated from the outer circumferential surface 26*c* of the stator core 26, so that a slight clearance is provided between the bottom surface 98*a* of the insertion member 98 and the outer circumferential surface 26*c* of the stator core 26.

The insertion members 61, 91 do not need to completely close the clearances C1, C2, C4 formed in the passing area 51, but a slight clearance may be formed between the insertion members 61, 91 and the stator core 26 or the passage forming portion 11*c*. Likewise, the insertion member 81 does not need to completely close the clearance C3 formed in the passing area 76, but a slight clearance may be formed between the insertion member 81 and the stationary scroll 20 or the first housing member 71.

In each of the above illustrated embodiments, the inverter 30 is attached to the outer surface of the bottom wall 11*e*, 72*e* in the second area K2, K4. Instead, the inverter 30 may be attached to the inverter housing member 17, 73 in the second area K2, K4. Since the bottom wall 11*e*, 72*e* and the inverter housing member 17, 73 are thermally coupled to each other, the inverter housing member 17, 73 is cooled via the bottom wall 11*e*, 72*e* when the bottom wall 11*e*, 72*e* is cooled by refrigerant. As a result, the inverter 30 is cooled.

In each of the above illustrated embodiments, the insertion members 61, 81, 91, 95, 98 may be made of metal or rubber.

In each of the above described embodiments, the compressing portion 15 is not limited to a type formed by the stationary scroll 20 and the movable scroll 21, but may be, for example, a piston type or a vane type.

What is claimed is:

1. A motor-driven compressor comprising:

a housing;

a partition defining inside the housing a first area and a second area, which are isolated from each other;

a compressing portion and an electric motor accommodated in the first area, wherein the electric motor is a drive source of the compressing portion;

a drive circuit for driving the electric motor, the drive circuit being arranged in the second area so as to have dissipation of the drive circuit;

a conductive member, which is electrically connected to the drive circuit and is fixed to the partition; and an electrical connection portion, which electrically connects the conductive member and the electric motor to each other, and comprising a cluster block, wherein a part of the electrical connection portion is located in a passing area formed between the housing and the electric motor, the cluster block including a connection terminal connected to the end of a lead wire, wherein a clearance is provided between an outer surface of the cluster block and an inner surface of the housing where the passing area is located, the housing has a suction port and a discharge port, the discharge port being located at a position that is farther from the partition than the suction port and the passing area, and an insertion member located in the passing area, wherein, after refrigerant is drawn into the housing via the suction port, the insertion member is configured to increase flow of refrigerant toward the partition by restricting flow of refrigerant toward the discharge port via the passing area, and wherein an outer surface of the insertion member contacts the inner surface of the housing where the passing area is located, wherein the cluster block is provided in the passing area and attached to an outer circumferential surface of a stator core of the electric motor, wherein the stator core is configured to be fitted in the housing by shrink fitting in a state that the cluster block is in the passing area and attached to the outer circumferential surface of the stator core of the electric motor, and wherein the insertion member is configured to be inserted into the passing area when the stator core is in the housing.

2. The motor-driven compressor according to claim 1, wherein the electric motor includes a rotor and a rotary shaft that rotates integrally with the rotor, the compressing portion, the electric motor, and the drive circuit are arranged in that order along the axial direction of the rotary shaft, and the lead wire is drawn toward the passing area from a part of the electric motor that faces the compressing portion.

3. The motor-driven compressor according to claim 2, wherein the insertion member is provided integrally with the cluster block.

4. The motor-driven compressor according to claim 1, wherein the insertion member is in contact with the housing and the electric motor.

5. The motor-driven compressor according to claim 1, wherein the drive circuit is attached to the partition in the second area.

6. The motor-driven compressor according to claim 1, wherein the insertion member is made of plastic.

7. The motor-driven compressor according to claim 1, wherein the insertion member has a passing portion for receiving a part of the electrical connection portion.

* * * * *